United States Patent [19]

Fletcher

[11] 4,155,721

[45] * May 22, 1979

[54] BONDING PROCESS FOR GRINDING TOOLS

[76] Inventor: J. Lawrence Fletcher, 3102 S. Pacific, Santa Ana, Calif. 92704

[ * ] Notice: The portion of the term of this patent subsequent to Mar. 21, 1995, has been disclaimed.

[21] Appl. No.: 888,081

[22] Filed: Mar. 20, 1978

Related U.S. Application Data

[63] Continuation-in-part of Ser. No. 521,439, Nov. 6, 1974, Pat. No. 4,079,552.

[51] Int. Cl.[2] ..... B24D 3/06; C25D 5/12

[52] U.S. Cl. ..... 51/295; 204/16

[58] Field of Search ..... 51/295, 309, 293; 204/16, 32 R, 38 S, 181

[56] References Cited

U.S. PATENT DOCUMENTS

| | | | |
|---|---|---|---|
| 2,360,798 | 10/1944 | Seligman et al. | 51/309 |
| 2,784,536 | 3/1957 | Barron | 51/309 |
| 3,356,599 | 12/1967 | Weiss | 51/293 |
| 3,488,892 | 1/1970 | Benner et al. | 51/309 |
| 3,650,714 | 3/1972 | Farkas | 51/309 |
| 3,785,938 | 1/1974 | Sam | 51/309 |
| 3,973,925 | 8/1976 | Asaeda et al. | 51/309 |
| 3,985,521 | 10/1976 | Borchard et al. | 51/295 |
| 4,079,552 | 3/1978 | Fletcher | 51/295 |

*Primary Examiner*—Donald J. Arnold

*Attorney, Agent, or Firm*—H. Ross Workman; Rick D. Nydegger

[57] ABSTRACT

A dual bonding process to make single layered tools wherein a metallic workpiece is pre-etched so as to form cavities in the surface of the workpiece for individually receiving diamond or other abrasive particles to be bonded thereto. The diamond particles are uniformly deposited and densely bonded to the surface of said metallic workpiece by a metallic bonding matrix applied in a first plating bath. A second selective plating of metal applied in a second plating bath more securely bonds the diamonds to the workpiece and provides the workpiece with a predetermined hardness for any selected grinding or cutting application. In order to make multilayered tools, this dual bonding process may be repeated for each layer applied.

17 Claims, 4 Drawing Figures

BONDING PROCESS FOR GRINDING TOOLS

BACKGROUND

1. Related Application

This application is a continuation-in-part of my copending U.S. patent application Ser. No. 521,439, filed Nov. 6, 1974 now U.S. Pat. No. 4,079,552.

2. Field of the Invention

This invention relates to a process for bonding abrasive particles to the surface of a metal workpiece.

3. The Prior Art

The hardness and abrasive qualities of diamonds are well known, particularly those of synthetically produced virgin polycrystalline diamond particles. Virgin polycrystalline diamond particles are of particular interest because of their greatly increased number of sharp points or cutting edges and lack of fracture planes.

Sharpening devices, grinding tools and the like (hereinafter designated as "workpieces") have been prepared from natural and synthetic diamond particles by bonding these particles together in the form of a sharpening stone using a ceramic or polymeric matrix to bond the diamond into a unitary structure. However, this process consumes an excessive amount of diamond particles, and the ceramic structure is also easily susceptible to fracture. For these reasons, workpieces have increasingly been prepared by bonding diamond particles to the surface of a metal workpiece, while immersed in an electrolytic plating bath, by electrodeposition of a metallic bonding matrix onto the workpiece and around the diamond particles.

Although workpieces produced according to this latter process have generally been more durable and less expensive to make than the ceramically bonded workpieces, they have nevertheless evidenced an inherent weakness in that the diamond particles tend to be pulled from the metal workpiece by abrasive action during use of the workpiece. It has been found that pulling out of the diamond particles can be minimized by controlling the hardness of the metallic bonding matrix or by increasing the thickness and controlling the hardness of the metallic bonding matrix. The hardness of a metallic bonding matrix can be changed by changing the type of metal used and/or by heat treatment, for various kinds of metals.

However, controlling the thickness and/or hardness of a metallic bonding matrix to prevent pulling out of the diamond particles results in other disadvantages. For example, if the metal bonding matrix is too thick and/or too hard for a given material to be cut or ground, the diamond particles will wear down faster than the bonding matrix, and the diamond particles will thus become coplanar with the bonding matrix. The workpiece cutting edge thus becomes glazed and thereafter ceases to work efficiently for purposes of grinding or cutting. When this happens, the workpiece must be re-dressed by abrading or otherwise treating the grinding surface of the workpiece. This of course results in increased cost and inconvenience to those using the workpiece.

Typically, glazing is caused by one of two conditions. If a given material is cut or ground, minute particles (called "swarf") tend to fill in the crevices between the diamond particles. Thus, one reason the cutting edge may become glazed is because the swarf is not abrasive enough to erode away the bonding matrix at the same rate as the abrasive particles are being worn down. The other reason the cutting edge may become glazed is because the metal bonding matrix is not slick enough, and thus swarf will adhere to the bonding matrix and will fill in the crevices as described above.

It would, therefore, be an improvement in the art to provide a process whereby diamond or other abrasive particles could be securely bonded to the surface of the workpiece so as to prevent pulling out of the abrasive particles, while at the same time forming a bonding matrix which would not be too hard or too thick, and which would be slick enough to minimize the adherence of swarf to the matrix, thus minimizing glazing of the cutting edge of the workpiece as it wears.

BRIEF SUMMARY AND OBJECTS OF THE INVENTION

The present invention comprises a novel process for more securely bonding polycrystalline diamond or other abrasive particles to the surface of a metallic workpiece. The novel process of the present invention includes preceding the diamond/metal plating step with an etching step so as to suitably cavitate the workpiece surface prior to plating with the diamond/metal surface. Etching is believed to create small cavities in the workpiece surface. Each cavity is adapted to individually receive a portion of a diamond particle, thereby providing for a stronger mechanical bond between the diamond/metal plated surface of the workpiece by recessing at least a part of the abrasive particle below the shear plane.

After etching, the workpiece is electroplated with diamond particles in a first plating bath having an aqueous solution of metal ions. In the first plating bath, a first metallic bonding matrix is plated onto the workpiece and around the individually partially embedded diamond particles. The first plating bath is followed by a further plating step wherein a second coat of metal is bonded around the diamond and over the first metal coating. Significantly, by properly choosing the type and thickness of this second metal coating, as the abrasive particles wear, the swarf will not significantly adhere to the matrix and the swarf will evenly wear down the second coat of metal veneer, thus maintaining a cutting edge so as to prevent glazing. Heat treatment after the second plating step serves to control stresses in the plated surfaces and thereby provide a stronger bonded surface on the workpiece to prevent pulling out of the abrasive particles.

It is, therefore, a primary object of the present invention to provide improvements in diamond bonding processes.

Another important object of the present invention is to provide a process whereby diamond or other abrasive particles can be securely bonded to the surface of a workpiece by a first metallic matrix, and where a second metallic matrix can thereafter be applied which will help to prevent glazing of the cutting edge of the workpiece.

Yet another object of the present invention is to provide a method whereby the rate of wear for a workpiece can be selected in accordance with an intended application by selecting the type and hardness of metal used as a second metal coating for a workpiece.

Another object of the present invention is to provide a second metallic bonding matrix having a selected slickness which tends to minimize adherence of swarf to the matrix.

A further object of the present invention is to help prevent pulling out of abrasive particles from the surface of a workpiece by recessing a portion of each particle out of the shear plane.

These and other objects and features of the present invention will become more fully apparent from the following description and appended claims taken in conjunction with the accompanying drawing.

DETAILED DESCRIPTION OF THE PREFERRED EMBODIMENTS

1. General

Figure 1:
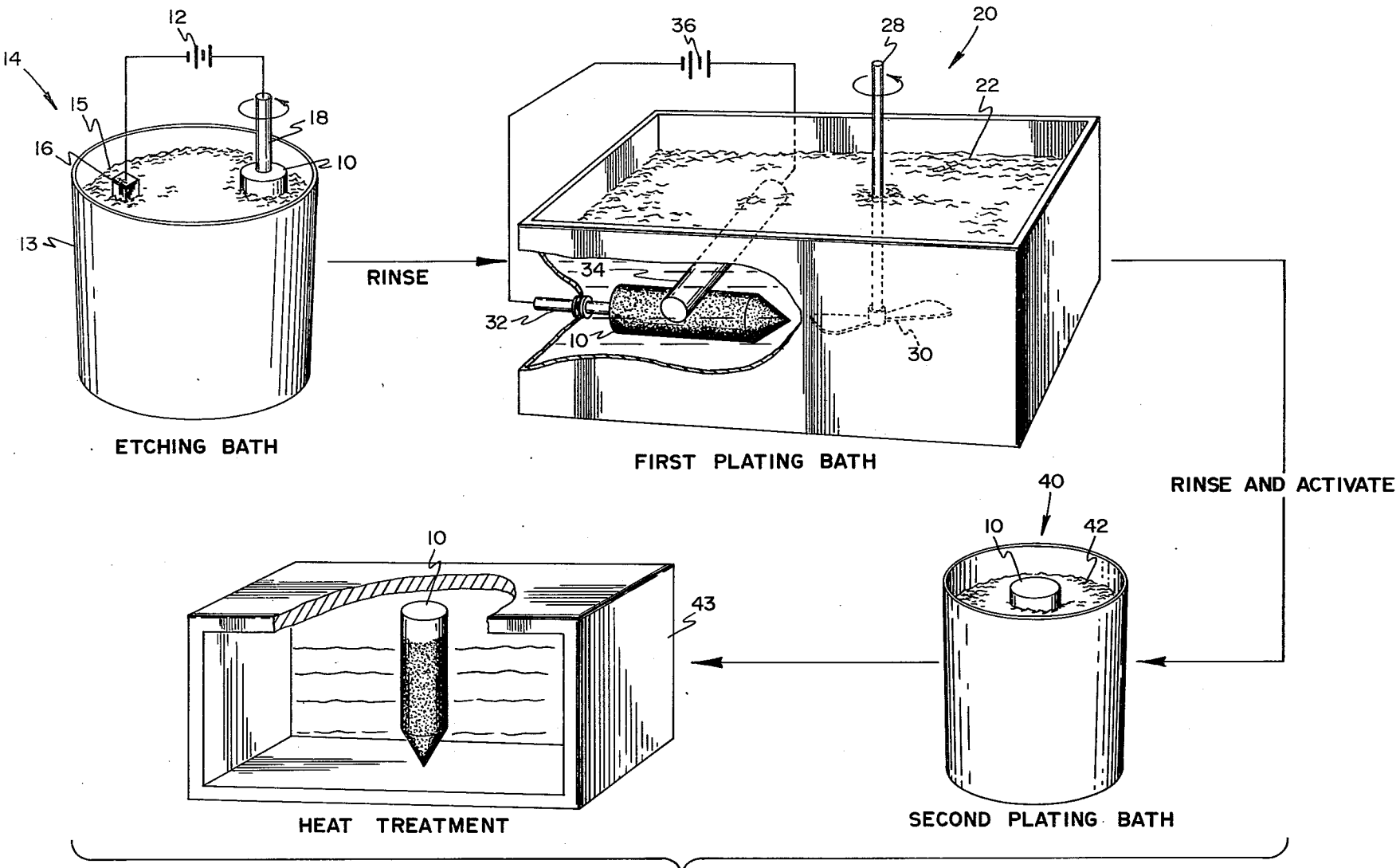
FIG. 1 is a schematic flow diagram demonstrating one presently preferred technique for preparing the diamond/metal plated workpiece of the present invention.

The invention is best understood by reference to the drawing wherein like parts are designated with like numerals throughout. The process of this invention is applicable to bonding any of a wide variety of abrasive particles, for example, diamond, boron nitride, silicon carbide and the like. For convenience, the process of this application will be described using diamond particles.

A workpiece that is plated with diamond particles advantageously incorporates the durability of diamond with the versatility of a metal substrate. While natural diamond or static synthesis diamond grit can be used, synthetically produced virgin polycrystalline diamond grit or particles are particularly useful due to their increased surface irregularities as compared to natural or static synthesis diamond particles.

Plating these diamond particles onto the surface of a metal workpiece provides a workpiece with an abrasive surface useful for many grinding and lapping applications, for example, those found in grinding wheels, lapping wheels, hones, tool sharpeners, etc.

In the foregoing applications, it is readily apparent that considerable stress is placed on each diamond particle during use of the workpiece. This stress tends to loosen and eventually break the diamond particles from the surface of the workpiece. These stresses also tend to break apart and tear loose the metal with which the diamond particles have been bonded to the surface of the workpiece. It has been found that this latter problem may be alleviated to some degree by etching the workpiece surface prior to plating with diamonds and metal so as to create cavities therein. The cavities form a pocket to receive a portion of a diamond particle so that part of the diamond particle is recessed out of the shear plane formed along the surface of the workpiece. The cavities also assist in forming a stronger mechanical bond between the workpiece and the plated surface.

According to the illustrated embodiment of the present invention, a layer of diamond particles is bonded to the surface of a metal workpiece through electrodeposition of nickel or other suitable metal to the workpiece. Diamond particles do not, in themselves, electroplate on the metal workpiece but are entrapped by the metal as it is electroplated thereon.

Uniform dispersion of diamond particles is assured by the constant agitation of the electroplating bath while an electromotive force imposed upon the bath assists in attracting the diamond particles to the workpiece, thereby enhancing the predetermined population and uniform packing of diamond particles on the workpiece surface. Constant agitation is herein defined to mean continuous agitation or periodic agitation adequate to maintain dispersion of the diamond particles. Alternatively, uniform plating of diamond particles may be achieved by burying the workpiece in a pile of diamond grit provided in the electroplating bath. In this manner, the workpiece is surrounded by diamond particles which may be uniformly plated onto the workpiece in a quiescent bath.

After a predetermined layer of diamond particles has been bonded to the surface of the workpiece by the plating action of the metal, the workpiece is immersed in a second plating bath. There, a second coat of only metal is deposited over the diamond/metal surface. When the type and thickness of this second coating of metal is properly selected for the intended application of the workpiece, the second coating of metal has the surprising advantage of wearing down evenly as the abrasive particles wear. This helps to prevent glazing of the cutting edge due to filling of the crevices between abrasive particles. Furthermore, as this second coat of metal wears, the abrasive particles will not loosen and pull out since they will remain firmly bonded to the cavities of the workpiece surface by the remainder of the second coat and by the first coat of metal.

The second plating step is then followed by heat treatment of the workpiece so as to harden and toughen the metal and relax any stresses that may have developed during any of the previous processing steps. Importantly, the temperature during heat treatment is held below the decomposition temperature of the diamond particles to preclude thermal decomposition.

2. The Embodiment of FIG. 1

Referring to FIG. 1, a workpiece 10 is shown in an etching bath 14 comprising a solution 15 of aqueous sulfuric acid. One suitable etching solution has a 60% sulfuric acid concentration. To assist in the etching of workpiece 10, an electromotive force indicated at 12 is imposed between workpiece 10 and a cathode 16 or even a metal vessel 13 containing the acid solution 15. A reverse D C current of about 4 amps at 5 to 6 volts for 6 or 7 minutes has been found adequate. To improve uniformity in the etching process, workpiece 10 may be rotated either continuously or intermittently in the bath with a rotatable shaft 18. Rotation of shaft 18 and workpiece 10 also agitates the solution and minimizes undesirable concentration of electrolytic action of any one portion of the surface of the workpiece thereby assuring more uniform etching. After etching, any remaining sulfuric acid is removed by rinsing workpiece 10 with water.

For some types of workpieces, as for example, those made from stainless steel or aluminum, an oxide coating may readily form on the surface of the workpiece after it is removed and rinsed. To prevent the formation of such oxide, it has been found to be desirable for some types of material to plate a very thin metal veneer coating onto the workpiece after it has been etched. This may be done by placing the workpiece 10 in a bath 40, (described below) for 6 to 10 seconds. This will result in a very thin metal coating (approximately 1 millionth of an inch, or 2.54 millionths of a centimeter) on the workpiece surface. This metal coating is sufficient to prevent oxide formation but is still thin enough to permit portions of the abrasive particles to be partially embedded in the cavities etched into the workpiece surface, as further described below. The workpiece 10 is then placed in a first plating bath generally designated 20.

Figure 2:
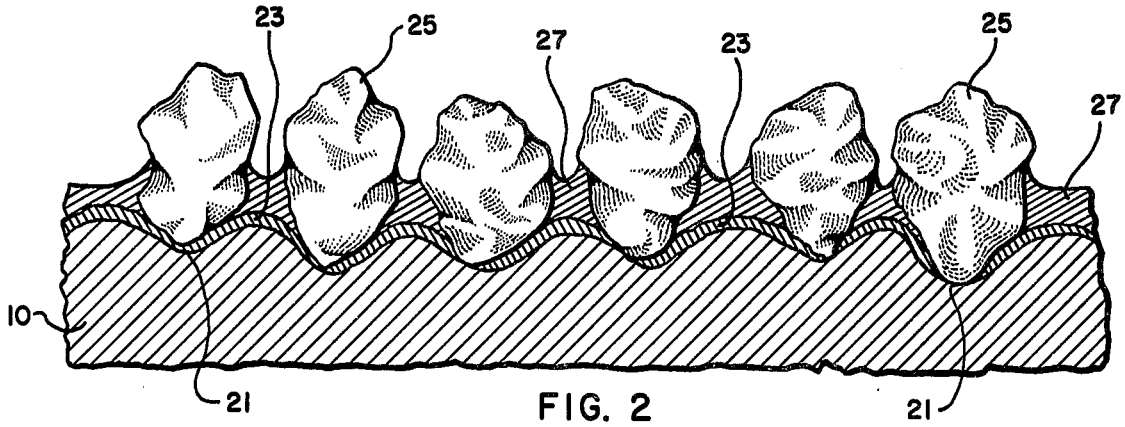
FIG. 2 is a schematic cross section of a workpiece that is diamond plated according to the presently preferred embodiment of the invention.

Plating bath 20 may contain any suitable metal plating solution. In the illustrated embodiment, plating bath 20 contains a nickel plating solution 22 which may be a standard aqueous solution of nickel sulfate and nickel chloride heated to about 120° F. This plating solution is well known in the art and is commonly referred to as a standard Watts bath. Conventionally, the plating solution includes about 15 to 50 ounces per gallon (113.1 to 377.2 grams per liter) nickle sulfate and 8 to 40 ounces per gallon (60.3 to 301.7 grams per liter) nickel chloride in a boric acid buffer. Diamond particles 25 (see FIG. 2) are suspended in the aqueous solution 22 so as to facilitate uniform distribution of diamond particles 25 on workpiece 10. Diamond particles 25 may be of any suitable size although the very fine particles (24 to 41 microns) are preferred for sharpening tools and the like.

Grinding wheels and related tools may require particle sizes upwards of 24 mesh. Diamond concentration of about 10–50% by volume was found to be most efficient to effect essentially uniform diamond distribution over the workpiece in order to obtain efficient grinding ratios for a broad range of workpieces, where grinding ratio defines the amount of abrasive consumed while grinding a given amount of material in a given application. Suspension of diamond particles 25 is maintained by vigorously agitating bath 22. In the illustrated embodiment, there is shown a conventional stirring device which includes, for example, an impellor 30 mounted upon a rotatable shaft 28 and driven by a motor (not shown). Alternatively, the solution 22 can be agitated hydraulically, electromechanically or with vibration. The flow of fluid and diamond particles caused by agitation advantageously serves to dislodge gas bubbles appearing at the workpiece 10 during the course of electrolysis.

Workpiece 10 is mounted upon a rotatable shaft 32 and suspended in plating bath 20. Substantial improvement in diamond plating has been found where the surface to be plated is situated out of the vertical plane. For example, it is presently preferred that the workpiece 10 be oriented horizontally in the electroplating bath 20. It is presently believed that non-vertical orientation permits the suspended diamond to be aided by gravity in coming to rest upon and being secured by the electrodeposition of nickel. While any number of angles with respect to the vertical appear to be effective, the horizontal is most effective. A nickel anode 34 is also suspended in plating bath 20. An electromotive force 36 is applied between workpiece 10 and anode 34 with workpiece 10 connected so as to act as a cathode. In this manner, workpiece 10 is plated with nickel metal ions. The plating action simultaneously entraps diamond particles 25 on the surface of workpiece 10 and the plated nickel metal 23 (see FIG. 2) serves to mechanically bond diamond particles 25 to the etched surface of workpiece 10 as the particles 25 are individually embedded in the cavities 21 of the etched surface.

The cavities 21 (FIG. 2) created in workpiece 10 during the etching step greatly assist in forming a strong bond between workpiece 10 and the first diamond-/nickel matrix 23. Many of the diamond particles 25 are partially recessed into the cavities 21 so as to limit their exposure to the shear plane formed along the diamond/-metal surface. The diamonds 25 thus secured have surprising resistance to shear and breakage away from the workpiece 10.

Continuous or intermittent rotation of workpiece 10 in bath 20 assures a more uniform plating of metal thereon and agitation by rotation of impellor 30 assures an even dispersion of diamond particles 25 throughout electroplating bath 20 and, accordingly, on the surface of workpiece 10. The thickness and concentration of the diamond particles 25 can be determined by controlling the speed of rotation of the workpiece (if rotated), the velocity of the bath, the size of the abrasive particles and the volume of abrasive particles per gallon of bath. It has also been discovered that the imposition of an electromotive force 36 appears to cause an attraction between diamond particles 25 and workpiece 10 so as to more densely pack diamond particles 25 on the surface of workpiece 10. For example, approximately 6 minutes has been found satisfactory to form a single layer of 24 to 41 micron diamond.

After suitably electroplating the diamond particles 25 to the surface of workpiece 10, workpiece 10 is removed from the plating bath and rinsed with water to remove any unplated residue from bath 20. While not essential, it has been found desirable to follow the rinsing step with an activation step wherein the diamond plated workpiece is treated by dipping or rinsing in a 50% hydrochloric acid solution prior to immersing the workpiece in a second plating bath 40. Surface activation is primarily used where the workpiece surface has been oxidized. If care is taken to avoid drying of the workpiece 10 during the etching and electroplating process, activation can usually be avoided. Prior to treatment in the second plating bath 40, the diamond adheres to the workpiece 10 as a soft pack.

With continued reference to FIG. 1, the second plating bath 40 comprises an electroless plating solution 42 of metal ions. The metal used may be nickel or any other suitable metal selected in accordance with the hardness and thickness characteristics desired in an intended application for workpiece 10. Any suitable electroless plating solution could be used such as solutions marketed by the Allied Kelite Division of Richardson Chemical Co. (Product No. 794 A, B and HZ). The workpiece is held in this electroless plating bath for sufficient time to achieve a suitable second coating of metal 27 (see FIG. 2). For example, approximately 70 to 80 minutes has been found adequate for many intended applications. The temperature in the electroless plating bath 40 is elevated to about 195° F. or such other elevated temperature as may be recommended by the manufacturer of the solution. It is pointed out that while electroless plating is preferred, electrolytic plating may be used. Nickel plating has been found to deposit about 0.0008 inches nickel per hour (0.02 millimeters per hour) in this bath and it is presently preferred to substantially interfill the surface area around the diamonds 25 and/or cover the diamonds 25 adhering to the workpiece.

After removal from the second or electroless plating bath 40, workpiece 10 is cleaned with water, dried and then subjected to heat treatment, in a furnace 43 wherein workpiece 10 is heated to approximately 600° F. for approximately one hour. Heat treatment between 650° F. and 750° F. for 1 hour yields a workpiece having a Rockwell C-Scale hardness of 72. Hardness of 46 to 72 has been found desirable. The actual hardness achieved is a function of the type of metal plated onto workpiece 10 in the second plating bath 40 and the temperature and firing time of the heat treatment step.

3. The Embodiments of FIGS. 3 and 4

Figure 3:
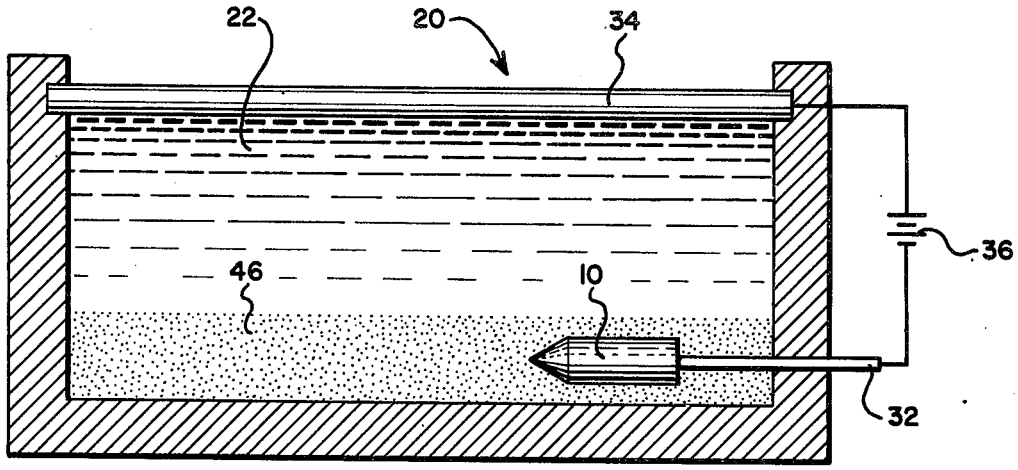
FIG. 3 is a schematic cross section of a workpiece being plated according to a second embodiment of the invention.
Figure 4:
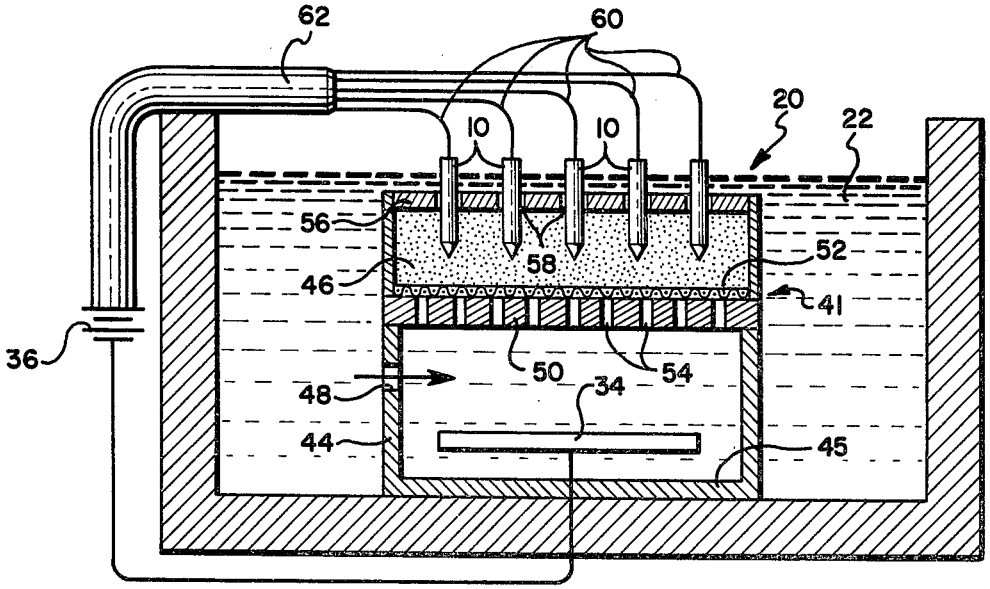
FIG. 4 is a perspective illustration which schematically represents a third technique for preparing the diamond/metal plated workpiece.

The embodiments shown in FIGS. 3 and 4 for electroplating diamond particles onto the etched surface of workpiece 10 differ from the embodiment described in connection with FIG. 1 primarily in the manner in which the diamond particles are electroplated onto the workpiece 10 in the first plating bath 20. In FIG. 3, the diamond particles are electroplated onto the workpiece 10 without agitating the aqueous solution 22 so as to suspend the diamond particles in the solution. As can be seen in FIG. 3, a layer of diamond particles 46 is allowed to settle at the bottom of the first plating bath 20. Thereafter, the workpiece 10 is buried within the layer 46 of diamond particles so as to be essentially surrounded thereby. Nickel or other metal is then plated onto the workpiece and around the diamond particles in the same manner described previously.

In the embodiment shown in FIG. 4, again the diamond particles are plated onto the workpiece 10 without suspending the diamond particles in the plating solution 22. As shown in FIG. 4, an enclosed box generally designated 41 is provided in the first plating bath 20. The box 41 has sides 44 and a bottom 45. Nickel anode 34 is placed in the bottom of box 41 and connected to an electromotive force 36 as described previously. A port 48 permits plating solution 22 to enter the box 41. Alternatively, port 48 may be used as an exit for plating solution 22 as hereinafter more fully described. A porous platform 50 is supported by sides 44 of box 41. A fine mesh net 52 is laid on top of porous platform 50 so as to prevent the diamond particles 46 from falling through the holes 54 of platform 50.

A second platform 56 covers the diamond particles 46. Platform 56 has a plurality of openings 58 through which workpieces 10 may extend so as to permit the etched portion of each workpiece 10 to be embedded into the layer of diamond particles 46. Importantly, openings 58 are only large enough to permit a very small tolerance between the workpiece 10 and opening 58. This prevents diamond particles 46 from being carried out of the openings 58 during the plating process. Each workpiece 10 is connected through a wire 60 of cable 62 to electromotive force 36.

In order to plate the workpiece 10, plating solution 22 is drawn through port 48 into box 41. Alternatively, plating solution 22 may be drawn through openings 58 and may exit through port 48. Plating solution 22 may be circulated through box 41 by a pump (not shown), by convection currents, or by gravity flow. The solution 22 and metal ions formed from anode 34 then are passed through porous platform 50 and net 52, and through the layer of diamond particles 46. Nickel or other metal is plated onto the workpiece 10 as the solution 22 circulates through box 41, and in this manner, diamond particles 25 may be uniformly plated into the cavities 21 (see FIG. 2) etched into the surface of the workpiece 10 through the electrodeposition of metal onto the workpiece and around the particles 25.

From the foregoing description of the preferred embodiments, it will be appreciated that the process of the present invention advantageously provides a stronger bond of diamond particles to the surface of a workpiece. Additionally, the second coating of metal plated onto the workpiece may be advantageously selected so as to provide a surface which will surprisingly enhance the wear of the workpiece by helping to prevent glazing of the cutting edge.

The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by U.S. Letters Patent is:

1. A process for bonding abrasive particles to the surface of a metal workpiece, the process comprising the steps of:

etching the surface of the workpiece so as to form cavities therein, said cavities generally being large enough to receive only a portion of one of the abrasive particles;

placing the etched workpiece in a first plating bath comprising an aqueous solution of metal ions;

introducing abrasive particles into said first plating bath;

placing a metal anode in the first plating bath and imposing an electromotive force across the anode and workpiece so as to cause abrasive particles to become individually partially embedded in the cavities of the etched surface of the workpiece as metal is plated onto the workpiece and around the embedded particles; and placing the workpiece in a second bath comprising an aqueous solution of metal ions and plating a second coat of metal around the partially embedded abrasive particles.

2. A process for bonding abrasive particles to the surface of a metal workpiece as defined in claim 1 wherein said second plating step is preceded by the step of removing the workpiece from the first plating bath and subjecting the workpiece to aqueous rinse.

3. A process for bonding abrasive particles to the surface of a metal workpiece as defined in claim 1, further comprising the steps of removing the workpiece from the second plating bath and then heat treating the workpiece so as to harden the metal plating.

4. A process for bonding abrasive particles to the surface of a metal workpiece as defined in claim 3 wherein said heat treating step comprises heating the workpiece to a temperature that is below the decomposition temperature of the abrasive particles for a sufficient period of time to achieve a predetermined hardness for the plated metal.

5. A process for bonding abrasive particles to the surface of a metal workpiece as defined in claim 1 wherein said step of placing the workpiece in a second plating bath comprising placing the workpiece in an electroless plating bath.

6. A process for bonding abrasive particles to the surface of a metal workpiece as defined in claim 1, further comprising the step of rotating the workpiece as metal is plated onto the workpiece.

7. A process for bonding abrasive particles to the surface of a metal workpiece as defined in claim 1 wherein said step of placing the workpiece in said first plating bath is preceded by the step of exposing the workpiece to an acid wash.

8. A process for bonding abrasive particles to the surface of a metal workpiece as defined in claim 1 wherein said step of placing the workpiece in said first plating bath is preceded by the step of plating a very thin metal coating onto said workpiece to prevent formation of oxide on the workpiece surface.

9. A process for bonding abrasive particles to the surface of a metal workpiece as defined in claim 1 wherein said step of plating a second coat of metal onto said workpiece comprises selectively plating a type of metal onto the workpiece which results in a predetermined hardness and slickness desired for a particular application of the workpiece.

10. A process for bonding abrasive particles to the surface of a metal workpiece, the process comprising the steps of:

etching the surface of the workpiece so as to form cavities therein, said cavities generally being large enough to receive only a portion of one of the abrasive particles;

preparing a first plating bath comprising an aqueous solution of metal ions;

placing a porous platform in said first bath;

supporting abrasive particles on said platform;

surrounding at least the etched portion of the workpiece with said abrasive particles which have been placed on said platform;

placing a metal anode in the first plating bath and imposing an electromotive force across the anode and workpiece so as to cause abrasive particles to become individually partially embedded in the cavities of the etched surface of the workpiece as metal is plated thereto;

plating a first coat of metal veneer around said abrasive particles and onto said workpiece as said plating solution is passed through said porous platform and the abrasive particles supported thereon and placing the workpiece in a second bath comprising an aqueous solution of metal ions and plating a second coat of metal around the partially embedded abrasive particles.

11. A process for bonding abrasive particles to the surface of a metal workpiece as defined in claim 10 wherein said step of plating a second coat of metal onto said workpiece comprises selectively plating a type of metal onto the workpiece which results in a predetermined grinding ratio for a particular application of the workpiece.

12. A process for bonding abrasive particles to the surface of a metal workpiece as defined in claim 10 wherein said step of plating a second coat of metal onto said workpiece comprises placing said workpiece into an electroless bath of metal ions.

13. A process for bonding abrasive particles to the surface of a metal workpiece, the process comprising the steps of:

etching the surface of said workpiece so as to improve the mechanical bond between said surface and a first coat of metal that is subsequently plated onto said surface;

placing the workpiece in a first plating bath comprising an aqueous solution of metal ions;

introducing abrasive particles into said first bath;

placing a metal anode in said first plating bath and imposing an electromotive force across the anode and workpiece so as to cause said abrasive particles to become plated onto the surface of the workpiece as a first coat of metal is plated onto the workpiece and around the particles; and placing the workpiece in a second plating bath comprising an aqueous solution of metal ions and plating a second coat of metal around the particles which were previously plated onto said workpiece in the first bath.

14. A process as defined in claim 13 wherein said second plating bath is electroless.

15. A process as defined in claim 14 wherein said step of plating a second coat of metal around the particles in said second plating bath comprises selectively plating a type of metal onto the workpiece which results in a predetermined grinding ratio for a particular application of the workpiece.

16. A process for bonding abrasive particles to the surface of a metal workpiece as defined in claim 13 wherein said step of placing the workpiece in said first plating bath is preceded by the step of plating a very thin metal coating onto said workpiece to prevent formation of oxide on the workpiece surface.

17. A process for bonding abrasive particles to the surface of a metal workpiece as defined in claim 10 wherein said step of placing the workpiece in said first plating bath is preceded by the step of plating a very thin metal coating onto said workpiece to prevent formation of oxide on the workpiece surface.

* * * * *

UNITED STATES PATENT AND TRADEMARK OFFICE

CERTIFICATE OF CORRECTION

PATENT NO. : 4,155,721

DATED : May 22, 1979

INVENTOR(S) : J. Lawrence Fletcher

It is certified that error appears in the above-identified patent and that said Letters Patent are hereby corrected as shown below:

Claim 5, column 8, line 60, "comprising" should be --comprises--

Claim 10, column 9, line 40, after "thereon" insert --;--.

Signed and Sealed this

*Sixteenth* Day of *October 1979*

[SEAL]

*Attest:*

RUTH C. MASON
*Attesting Officer*

LUTRELLE F. PARKER
*Acting Commissioner of Patents and Trademarks*